US005346400A

United States Patent [19]

Shin

[11] Patent Number: 5,346,400

[45] Date of Patent: Sep. 13, 1994

[54] SENSOR ROTATING APPARATUS

[75] Inventor: Dong-Il Shin, Seoul, Rep. of Korea

[73] Assignee: Samsung Electronics Co., Ltd., Kyongki, Rep. of Korea

[21] Appl. No.: 1,712

[22] Filed: Jan. 6, 1993

[30] Foreign Application Priority Data

Jan. 6, 1992 [KR] Rep. of Korea ..... 92-34

[51] Int. Cl.[5] ..... H01R 39/02

[52] U.S. Cl. ..... 439/17; 439/19

[58] Field of Search ..... 439/17-21, 439/28

[56] References Cited

U.S. PATENT DOCUMENTS 4,462,648 7/1984 Föhl ..... 437/20 X

FOREIGN PATENT DOCUMENTS 923578 3/1973 Canada ..... 439/18

*Primary Examiner*—Eugene F. Desmond

*Attorney, Agent, or Firm*—Sughrue, Mion, Zinn, Macpeak & Seas

[57] ABSTRACT

A sensor rotating apparatus for allowing a sensor to have a sensing angle of 360 degrees includes a drive motor, first and second reduction gear assemblies for reducing the rotational power of the motor, a sensor turntable for rotating a sensor using the reduced rotational power of the motor, a hub for rotatably supporting the sensor turntable, a rotating shaft for rotating at the same time of rotation of the sensor turntable and transmitting a sensing signal of the sensor to a control circuit unit, a bearing assembly for supporting rotation of the rotating shaft and being electrically connected to input terminals of the rotating shaft, and a support member for preventing the bearing assembly from undesirable separation from the rotating shaft due to the rotational force of the shaft.

11 Claims, 4 Drawing Sheets

SENSOR ROTATING APPARATUS

FIELD OF THE INVENTION

The present invention relates in general to a rotating system for sensors. More particularly, the present invention relates to a sensor rotating apparatus capable of rotating a sensor at a rotational angle of 360 degrees without twisting wires of the sensor, thereby allowing the sensor to have a sensing angle of 360 degrees.

BACKGROUND OF THE INVENTION

Conventionally, a sensor is mounted on a predetermined position and has a maximum sensing angle of 180 degrees. Therefore, it is necessary to mount at least two sensors at individual positions in order to cover a desired sensing angle of 360 degrees. The known sensor arrangement has a problem in that in order to electrically wire each of the sensors, it is necessary to provide a plurality of wires. Further, the known sensor arrangement is time consuming to install, thereby increasing labor costs. In addition, in wiring a building for the sensors, it may be necessary for the wall of the building where the sensors are to be arranged to be partially broken and this causes the partially broken wall to be repaired after the sensor wiring is completed, thereby further increasing the installation cost of the sensors. The sensors may be installed on the wall of the building in such a manner that the wires of the sensors are exposed to the outside of the wall, thereby obviating the need to partially break a wall. However, a problem is attendant with this type of sensor wiring in that the exposed wires may be easily short-circuited or disconnected due to the exposed nature of the wiring. Furthermore, such external wiring provides a poor appearance.

SUMMARY OF THE INVENTION

It is, therefore, an object of the present invention to provide a sensor rotating apparatus in which the above problems of the known sensor are overcome and which simplifies the wiring of the sensor and rotates the sensor at a rotational angle of 360 degrees without twisting wires of the sensor and, as a result, allows the sensor to have a sensing angle of 360 degrees.

In accordance with an embodiment of the invention, the above object can be accomplished by providing a sensor rotating apparatus comprising: a drive motor for generating rotational output power;

first and second reduction gear assemblies cooperating with the drive motor in order to reduce the rotational output power of the drive motor in accordance with a predetermined gear ratio thereof;

a sensor turntable for rotating at a predetermined rotating velocity which is determined by the gear ratio of the first and second reduction gear assemblies and carrying a sensor thereon in order to cause this sensor to rotate at the same time of its rotation;

a casing having a hub for rotatably supporting the sensor turntable;

a housing holder extending downwardly from the casing in order to be oppositely arranged to the hub;

a rotating shaft for rotating at the same time of rotation of the sensor turntable and transmitting a sensing signal of the sensor to a control circuit unit, said rotating shaft being inserted in both said hub and said housing holder and having a pair of longitudinal grooves for receiving a pair of input terminals for transmitting the sensing signal of the sensor and being fixed to the sensor turntable using a first fixing member in order to rotate at the same time of rotation of the sensor turntable;

a bearing assembly for supporting the rotation of the rotating shaft, said bearing assembly being electrically connected to the pair of input terminals of the rotating shaft and being arranged as surrounding the rotating shaft; and a support member for preventing the bearing assembly from undesirable separation from the rotating shaft due to the rotational force of the rotating shaft, said support member being mounted on a lower end of the rotating shaft using a second fixing member.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 1:
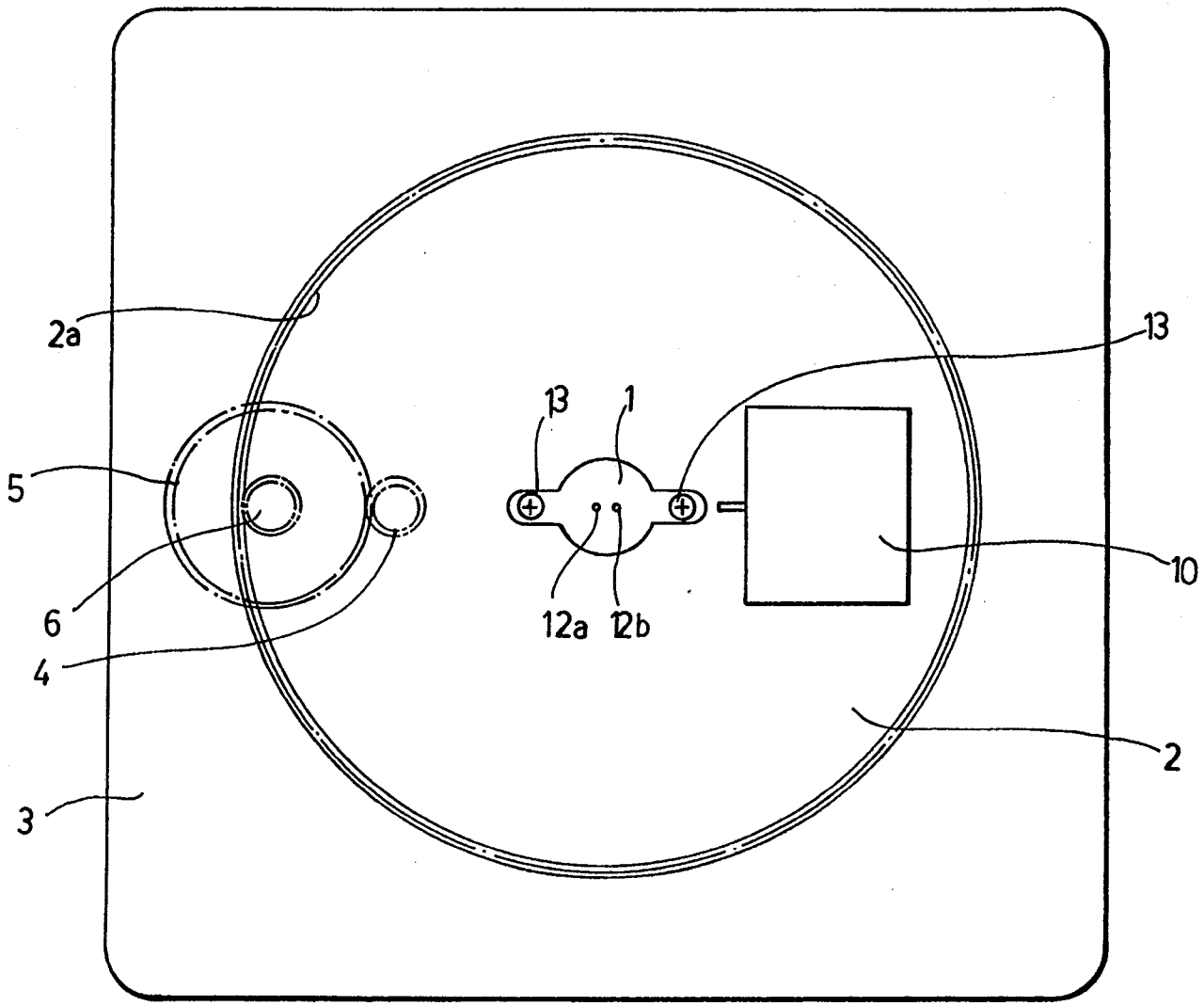
FIG. 1 is a plan of an embodiment of a sensor rotating apparatus accordance with the present invention.
Figure 2:
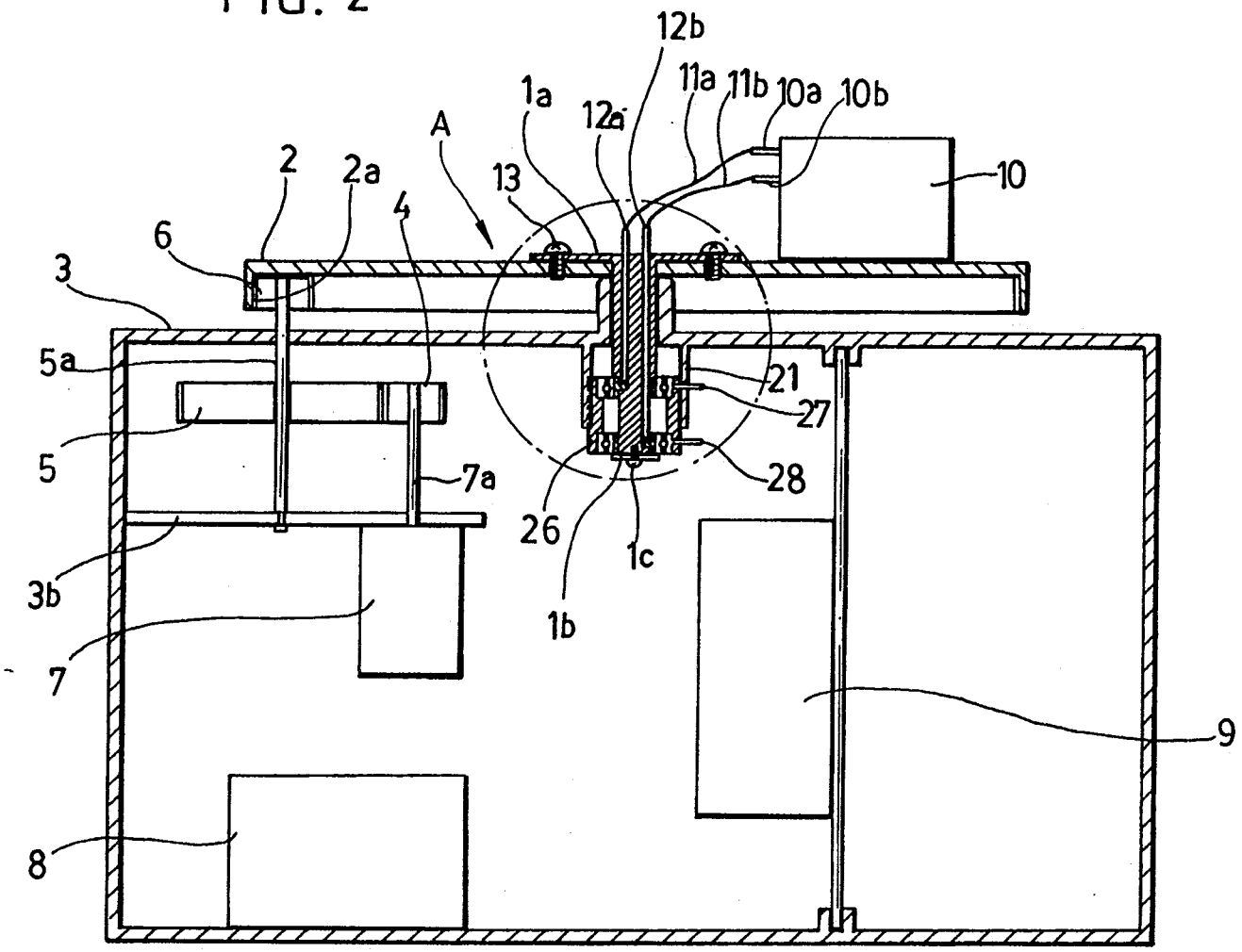
FIG. 2 is a sectional view of the sensor rotating apparatus of FIG. 1.

FIGS. 1 and 2 show a preferred embodiment of a sensor rotating apparatus according to the invention. The apparatus includes a main casing 3 in which a power supply 8 is arranged at a lower position thereof. In the main casing 3, the power supply 8 is electrically connected, through a conductor (not shown), to a control circuit unit 9 having a sensor circuit and an alarm circuit. Above the power supply 8, the apparatus further includes a support **3*b* which extends horizontally inwardly from a side wall, for example, a left-side wall, of the main casing 3 in order to extend parallel with the upper plate of the main casing 3. The support 3*b* supports a motor 7 at its lower surface. The motor 7 outputs its power to a first reduction gear assembly comprising a pair of spur gears 4 and 5 having a predetermined gear ratio and being engaged with each other. In this reduction gear assembly, the spur gear 4 is mounted on a motor output shaft 7*a* in order to cooperate with the motor 7. The first gear assembly 4 and 5 is adapted to reduce the rotational velocity of the output shaft 7*a* of the motor 7 and, as a result, to lower the output power of the motor 7. The spur gear 5 of the reduction gear assembly is in turn connected, through a shaft 5*a*, to a spur gear or a pinion 6 which will be described below. At a center of the upper plate of the main casing 3, a cylindrical housing holder 21** is integrally provided such that it extends downwardly from the center of the upper plate and opens at its upper and lower ends.

Figure 3:
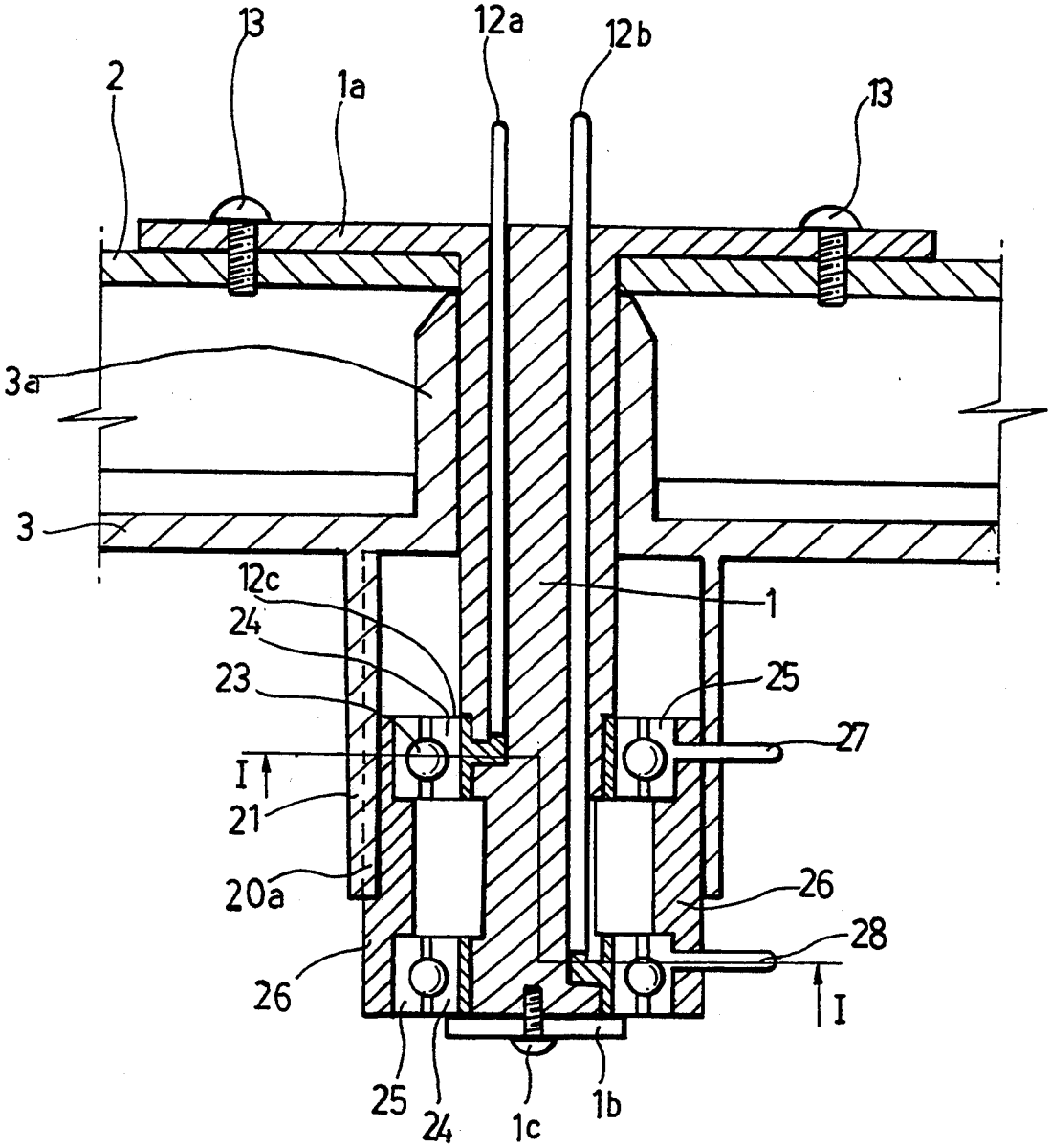
FIG. 3 is an enlarged sectional view of the a section labelled A of FIG. 2 for showing in detail a construction of a rotating shaft and a bearing assembly.

FIG. 3 is an enlarged view of the section A of FIG. 2 for showing a rotating part of the apparatus. As shown in FIGS. 2 and 3, the upper plate of the main casing 3 also has an integral cylindrical hub **3*a* which extends upwardly from the center of the upper plate in order to be concentric with the housing holder 21. On the top end of the hub 3***a*, a sensor turntable 2 of a circular shape is rotatably mounted. This turntable 2 is combined with the internal gear 2*a* in order to rotate at the same time of rotation of the internal gear 2*a* and has a circular center opening for permitting a rotating shaft 1 to pass therethrough.

The rotating shaft 1 is inserted in the cylindrical center opening of the sensor turntable 2, an inner cylindrical hole of the hub 3*a* and an inner cylindrical hole of the housing holder 21 in that order. The rotating shaft 1 is integrally provided at its uppermost end with a base disc 1*a* which is combined with the sensor turntable 2 using a pair of set screws 13. The rotating shaft 1 rotates at the same time of rotation of the sensor turntable 2 when the pinion 6 drives the internal gear 2*a* as well as the sensor turntable 2.

On the sensor turntable 2, a sensor 10, for example, an ultrasonic sensor or an infrared sensor, is mounted at a desired position using a mounting device (not shown). The sensor 10 is provided with a pair of output terminals 10*a* and 10*b* for outputting a sensing signal. With this construction, the sensor 10 is allowed to rotate at the same time of rotation of the sensor turntable 2 and, as a result, has a desired sensing angle of 360 degrees.

Figure 4:
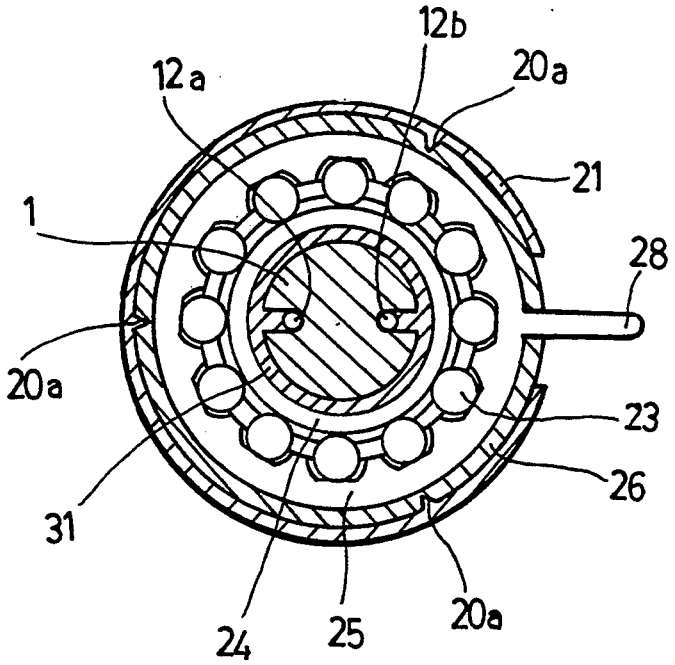
FIG. 4 is sectional view taken along the section line I—I of FIG. 3.

FIG. 4 shows a construction of the rotating shaft 1 and a ball bearing assembly for supporting the rotation of the shaft 1 with respect to the housing holder 21. Referring to FIGS. 2 to 4, the rotating shaft 1 is preferably made of insulation materials, such as ABS (acrylonitrile-butadiene-styrene) resins and ceramic materials of alumina (aluminum oxide) and kaolin (china clay), in order to insulate the shaft 1 from the peripheral members, such as the hub 3*a* and the housing holder 21. The shaft 1 is provided with a pair of longitudinal grooves which are diametrically oppositely formed in order to receive individual input terminals 12*a* and 12*b*. Specifically, the shaft 1 permits the pair of input terminals 12*a* and 12*b*, which preferably comprise pin-shaped conductors made of conductive materials and are received in individual grooves of the shaft 1, to rotate at the same time of rotation of the shaft 1. The input terminals 12*a* and 12*b* are connected to the output terminals 10*a* and 10*b* of the sensor 10 through individual lead wires 11*a* and 11*b*. Furthermore, one of the input terminals, for example, the terminal 12*a*, is shorter than the other input terminal, for example, the terminal 12*b*, as depicted in FIG. 3. In addition, a pair of conductive rings 31 are arranged at lower positions of the shaft 1 in order to be connected to lower ends of individual input terminals 12*a* and 12*b*. With this construction, the input terminals 12*a* and 12*b*, along with individual rings 31, rotate at the same time of rotation of the shaft 1.

With reference to FIG. 4, the bearing assembly comprises a pair of radial ball bearings which are arranged at positions corresponding to the rings 31. Each of the ball bearings is made of a conductive material and includes an inner ring or a shaft washer 24 which is mechanically combined with a ring 31 and a plurality of metal balls 23 for causing the shaft washer 24 along with the ring 31 to smoothly rotate at the same time of rotation of the shaft 1. In order to maintain the metal balls 23 in their respective positions, the ball bearing also includes an outer ring 25 of which an inner surface is provided with a plurality of ball slots for receiving individual metal balls 23. The outer ring 25 is also provided with a pin-shaped sensor output terminal 27 (FIG. 3) or 28 (FIG. 4) at its outer surface. The bearing assembly also includes a cylindrical bearing housing 26 which supports the outer rings 25 of the ball bearings as surrounding the outer surfaces of the rings 25. On the outer surface of the bearing housing 26, three longitudinal slots are provided in order to be combined with individual inner protrusions 20*a* of the housing holder 21. Due to the combination of the bearing housing 26 and the housing holder 21, the bearing housing 26 along with the outer rings 25 of the bearings do not rotate when the shaft washers 24 along with the rings 31 rotate at the same time of rotation of the shaft 1. In addition, the bearing housing 26 has a pair of radial through holes for permitting individual pin-shaped sensor output terminals 27 and 28 to pass therethrough.

In arranging the rotating shaft 1 and the bearing assembly in the main casing 3, the pinion 6 (FIG. 2) is mounted on the shaft 5*a* of the spur gear 5 of the first reduction gear assembly. Thereafter, the sensor turntable 2 is arranged on the hub 3*a* of the main housing 3 in such a manner that its internal gear 2*a* engages with the pinion 6. The rotating shaft 1 is, thereafter, inserted in the cylindrical center opening of the sensor turntable 2, the inner cylindrical hole of the hub 3*a* and the inner cylindrical hole of the housing holder 21 in that order. At this state, the base disc 1*a* of this rotating shaft 1 is combined with the sensor turntable 2 using the pair of set screws 13. The bearing assembly is then tightly fitted on the lower part of the rotating shaft 1 through the lower opening of the housing holder 21.

Thereafter, in order to prevent the bearing assembly from undesirable separation from the shaft 1 due to the rotational force of the shaft 1, the rotating shaft 1 and the bearing assembly are supported by a support member 1*b* which is mounted on the lower end of the shaft 1 using a set screw 1*c*. In accordance with the above assembly, the sensor turntable 2 along with the rotating shaft 1 rotates at the same time of rotation of the internal gear 2*a* which is driven by the output power of the motor 7.

The operation of the sensor rotating apparatus according to the invention will now be described.

Upon powering on, the motor 7 outputs its power, i.e., the rotational power, to the first reduction gear assembly 4 and 5 through its output shaft 7*a*. At the reduction gear assembly 4 and 5, the rotational power of the motor 7 is reduced as much as the gear ratio of the gear assembly 4 and 5. The reduced rotational power of the motor 7 is in turn transmitted to the pinion 6 which is connected to the shaft 5*a* of the reduction gear 5. Since the pinion 6 engages with the internal gear 2*a* of the sensor turntable 2, the rotation of the pinion 6 causes the internal gear 2*a* to rotate in order to rotate the sensor turntable 2 at a predetermined slow rotating velocity. At this time, the sensor 10, such as an ultrasonic sensor or an infrared sensor mounted on the predetermined position of the sensor turntable 2, rotates at the same time of slow rotation of the sensor turntable 2 in a predetermined rotating direction. During its rotation, sensor 10 emits ultrasonic waves or infrared rays in order to sense a moving object or infrared rays of the human body and outputs a sensing signal from its output terminals 10*a* and 10*b*. This sensing signal is applied to the input terminals 12*a* and 12*b* through the lead wires 11*a* and 11*b* and in turn to the conductive rings 31. The bearing assembly, comprising the shaft washers 24, the balls 23 and the outer rings 25, is made of conductive materials as described above and, transmits the sensing signal, which has been applied to the rings 31, to the output terminals 27 and 28. Thereafter, the sensing signal is transmitted from the output terminals 27 and 28 to the control circuit unit 9 having the sensor circuit and the alarm circuit through lead wires (not shown).

The sensor rotating apparatus rotates the sensor 10 at the desired rotational angle of 360 degrees without twisting wires of the sensor 10 and, as a result, allows the sensor 10 to have the sensing angle of 360 degrees.

The bearing housing 26 is tightly received in the housing holder 21 in such a manner that the three longitudinal slots of the housing 26 receives individual inner protrusions 20*a* of the housing holder 21 as described above and this allows the bearing housing 26 to be fixed to the main casing 3. The bearing housing 26 along with the outer rings 25 of the bearing assembly, do not rotate when the shaft washers 24 along with the rings 31 rotate at the same time of rotation of the shaft 1.

As described above, the present invention provides a sensor rotating apparatus capable of rotating a sensor at a sensing angle of 360 degrees without twisting wires of the sensor. In the sensor rotating apparatus, a pair of pin-shaped input terminals, other than lead wires, are received in a rotating shaft of a sensor turntable in order to electrically connect the sensor to a control circuit unit. A plurality of lead wires can be removed from the sensor wiring and this simplifies the wiring of the sensor and, as a result, remarkably reduces the installation cost of the sensor. In addition, the apparatus does not cause twisting of the wires of the sensor, thereby preventing short circuit and disconnection of the sensor wires. Another advantage of the apparatus is that it has a simple construction.

Although the invention has been shown in connection with a certain specific embodiment, it will be readily apparent to those skilled in the art that various changes in form and arrangement of parts may be made to suit requirements without departing from the spirit and scope of the invention.

What is claimed is:

1. A sensor rotating apparatus comprising:

drive means for generating a rotational output power;

first and second reduction gear assemblies for reducing the rotational output power of said drive means, said first and second gear assemblies cooperating with said drive means and having a predetermined gear ratio;

a sensor turntable for causing, using the reduced rotational output power of said drive means, a sensor to rotate, said sensor turntable carrying said sensor at a predetermined position thereon and rotating at a predetermined rotating velocity which is determined in accordance with said gear ratio of the first and second reduction gear assemblies;

a casing having a hub for rotatably supporting said sensor turntable;

a housing holder extending downwardly from said casing in order to be oppositely arranged to said hub;

a rotating shaft for rotating at a same time of rotation of said sensor turntable and transmitting a sensing signal of said sensor to a control circuit unit, said rotating shaft being inserted in both said hub and said housing holder and having a pair of longitudinal grooves for receiving a pair of input terminals for transmitting said sensing signal of the sensor and being fixed to said sensor turntable using a first fixing member in order to rotate at the same time of rotation of said sensor turntable;

a bearing assembly for supporting said rotating shaft, said bearing assembly being electrically connected to said pair of input terminals of the rotating shaft and being arranged so as to surround said rotating shaft; and support means for preventing said bearing assembly from undesirable separation from said rotating shaft due to the rotational force of said rotating shaft, said support means being mounted on a lower end of said rotating shaft using a second fixing member.

2. The sensor rotating apparatus according to claim 1, wherein said first and second reduction gear assemblies comprise a plurality of spur gears.

3. The sensor rotating apparatus according to claim 1, wherein said first and second fixing members comprise set screws.

4. The sensor rotating apparatus according to claim 1, wherein said rotating shaft is made of an acrylonitrile-butadiene-styrene resin.

5. The sensor rotating apparatus according to claim 1, wherein said rotating shaft is made of a ceramic material comprising aluminum oxide and kaolin clay.

6. The sensor rotating apparatus according to claim 1, wherein said bearing assembly comprises:

a pair of ball bearings, each comprising:

a shaft washer which is mechanically combined with a ring, said ring being electrically connected to one of said pair of input terminals of the rotating shaft;

a plurality of metal balls for causing said shaft washer along with said ring to rotate smoothly at the same time of rotation of said rotating shaft; and an outer ring having an inner surface which is provided with a plurality of ball slots for respectively receiving said metal balls in order to maintain said metal balls in their places and an outer surface which is integrally formed with a sensor output terminal; and a bearing housing for supporting said outer rings of the pair of ball bearings by surrounding the outer surfaces of said outer rings, said bearing housing having at its outer surface a plurality of slots for receiving individual inner protrusions of said housing holder to prevent rotation of said bearing housing at the same time of rotation of said rotating shaft, said bearing housing also having through holes for permitting said sensor output terminals of the outer rings of the ball bearings to pass therethrough.

7. The sensor rotating apparatus according to claim 1, wherein said bearing assembly is made of a conductive material.

8. A sensor rotating apparatus comprising:

drive means for generating a rotational output power;

a gear assembly for reducing the rotational output power of said drive means according to a predetermined gear ratio;

a sensor for providing a sensing signal;

a sensor turntable for carrying said sensor at a predetermined position thereon and for rotating said sensor at a predetermined rotating velocity;

a rotating shaft for rotating at a same time of rotation of said sensor turntable and transmitting the sensing signal of said sensor to a control circuit unit, said rotating shaft receiving a pair of input terminals for transmitting said sensing signal and being fixed to said sensor turntable so as to rotate at the same time of rotation of said sensor turntable;

a bearing assembly for supporting said rotating shaft, said bearing assembly being electrically connected to said pair of input terminals of the rotating shaft; and support means, mounted on said rotating shaft, for preventing said bearing assembly from separating from said rotating shaft.

9. The sensor rotating apparatus according to claim 8, further comprising:

a casing having a hub for rotatably supporting said sensor turntable; and a housing holder extending downwardly from said casing so as to be oppositely arranged to said hub.

10. The sensor rotating apparatus according to claim 8, wherein said gear assembly comprises first and second gear assemblies having a predetermined gear ratio.

11. The sensor rotating apparatus according to claim 9, wherein said rotating shaft is inserted in said hub and said housing holder, and includes a pair of longitudinal grooves for receiving the input terminals.

* * * * *